United States Patent [19]

Knapp

[11] 3,972,531

[45] Aug. 3, 1976

[54] INDICATING TARGET FOR PROJECTILES

[76] Inventor: Jimmie L. Knapp, 8128 E. Hubbell St., Scottsdale, Ariz. 85257

[22] Filed: Nov. 29, 1974

[21] Appl. No.: 528,329

[52] U.S. Cl. ..... 273/102.2 R; 273/181 J

[51] Int. Cl.[2] ..... A63B 65/02

[58] Field of Search ..... 273/102.2 R, 102.2 A, 273/26 A, 102.1 R, 102.1 C, 102.1 B, 102.1 F, 127 R, 136 A, 137 A, 181 R, 181 J

[56] References Cited

UNITED STATES PATENTS

| | | | |
|---|---|---|---|
| 2,040,228 | 5/1936 | Whiteley | 273/102.2 R |
| 2,695,173 | 11/1954 | Sterne | 273/102.2 R |
| 2,818,560 | 12/1957 | Edrich | 273/102.2 R |
| 3,206,196 | 9/1965 | Jackson | 273/26 A |
| 3,254,433 | 6/1966 | Saile | 273/102.2 R |
| 3,454,276 | 7/1969 | Brenkert | 273/102.2 R |
| 3,550,941 | 12/1970 | Spiro | 273/102.2 R |

*Primary Examiner*—Anton O. Oechsle
*Assistant Examiner*—Marvin Siskind
*Attorney, Agent, or Firm*—Warren F. B. Lindsley

[57] ABSTRACT

An indicating target wherein displacement of individual target sectors in reaction to the impact of a projectile causes the momentary closing of an electrical contact; the closing of the contact causing the temporary energization of a lamp which illuminates the target segment struck for a brief period before the lamp is automatically extinguished by timing circuits.

4 Claims, 5 Drawing Figures

FIG-1
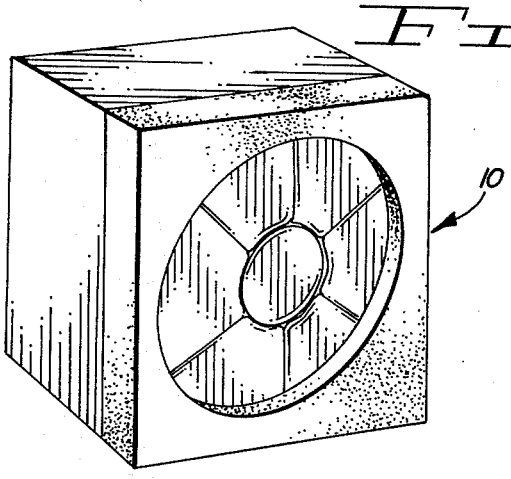
FIG-2
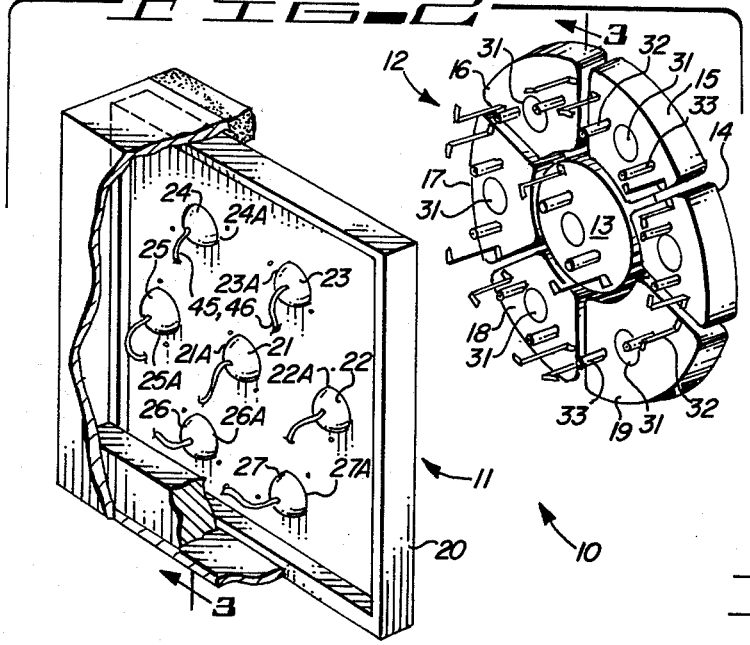
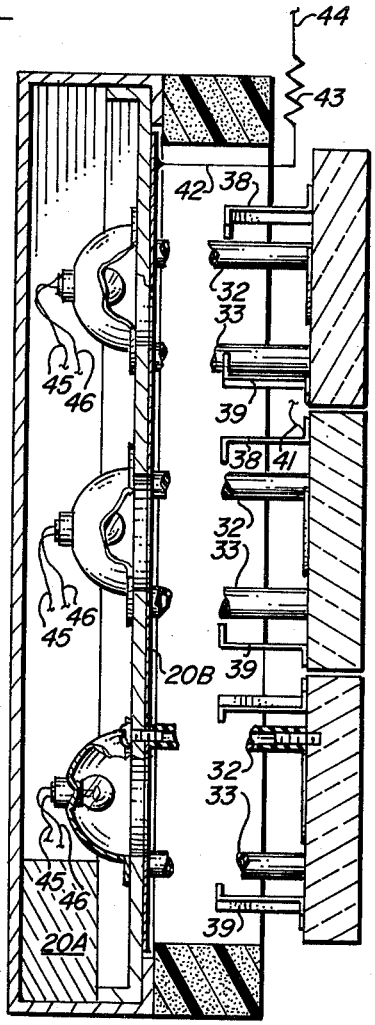
FIG-3
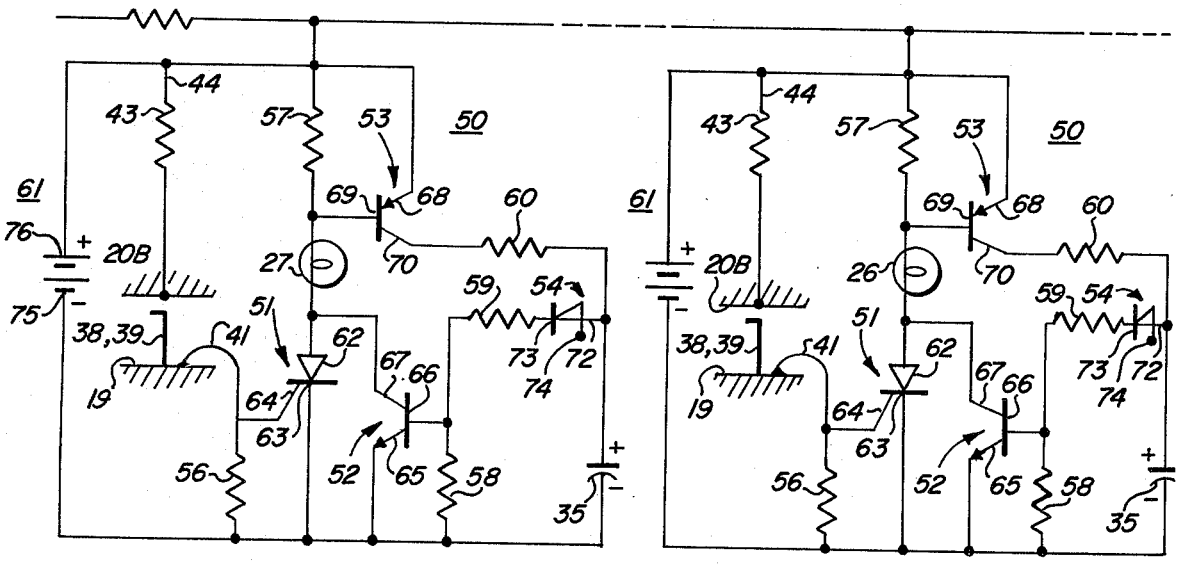
FIG-4

INDICATING TARGET FOR PROJECTILES

BACKGROUND OF THE INVENTION

Target shooting is popular with bow and arrow, guns, darts and the like both as a sport and form of amusement and with regard to guns, as a serious means for improving shooting skills required in connection with legitimate and worthwhile vocational pursuits such as law enforcement and military service.

Various types of targets have been devised over the years to aid the practitioner but none have been fully automatic.

U.S. Pat. No. 346,876 granted in 1886 on an annunciator target displayed on a replica of the target the location of the point struck by the projectile. Related devices accomplishing similar purposes were patented in 1894 in U.S. Pat. No. 521,049 and in 1910 in U.S. Pat. No. 954,997. All of these devices utilize relatively complex mechanical constructions wherein the impact of the projectile closed an electrical switch incorporated in the target structure. In the case of U.S. Pat. Nos. 346,876 and 954,997, a long connective cable was required between the target and the annunciator.

Other innovations in the field include special targets with parallel electrically conductive membranes which are either pierced by a conductive projectile or momentarily deformed into electrical contact with each other by the projectile, the closing of the electrical circuit in either case being utilized to identify the location struck within a defined locational grid. The location is then electrically recorded. U.S. Pat. No. 3,677,546 is an example of such a construction.

SUMMARY OF THE INVENTION

In accordance with the invention claimed, an improved indicating target is provided wherein a flashing light defines the sector of the target struck by a projectile, the indicating target automatically resetting the indicator after a predetermined time prior to the next shot.

It is, therefore, one object of this invention to provide an improved indicating target.

Another object of this invention is to provide an improved indicating target wherein an electric lamp illuminates the particular sector of the target which is struck by the projectile.

A further object of this invention is to provide an indicating target wherein the illuminating lamp is flashed for a predetermined time for improved visibility and recognition at relatively great distances.

A still further object of this invention is to provide an indicating target wherein the indicating means is automatically turned off or reset after a brief interval.

A still further object of this invention is to provide an improved indicating target in a simple and inexpensive form which is lightweight, compact, portable and easily maintained.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which:

FIG. 1 is a perspective view of an indicating target embodying the invention;

FIG. 2 is an exploded view showing the major mechanical parts employed in the indicating target structure;

FIG. 3 is a cross-sectional view of the major mechanical parts shown in their assembled relationship as viewed in the direction indicated by lines 3—3 of FIG. 2;

FIG. 4 is a schematic representation of two of the modular electronic circuits utilized in the indicating and resetting functions incorporated in the target structure.

DESCRIPTION OF THE PREFERRED EMBODIMENT

Figure 5:
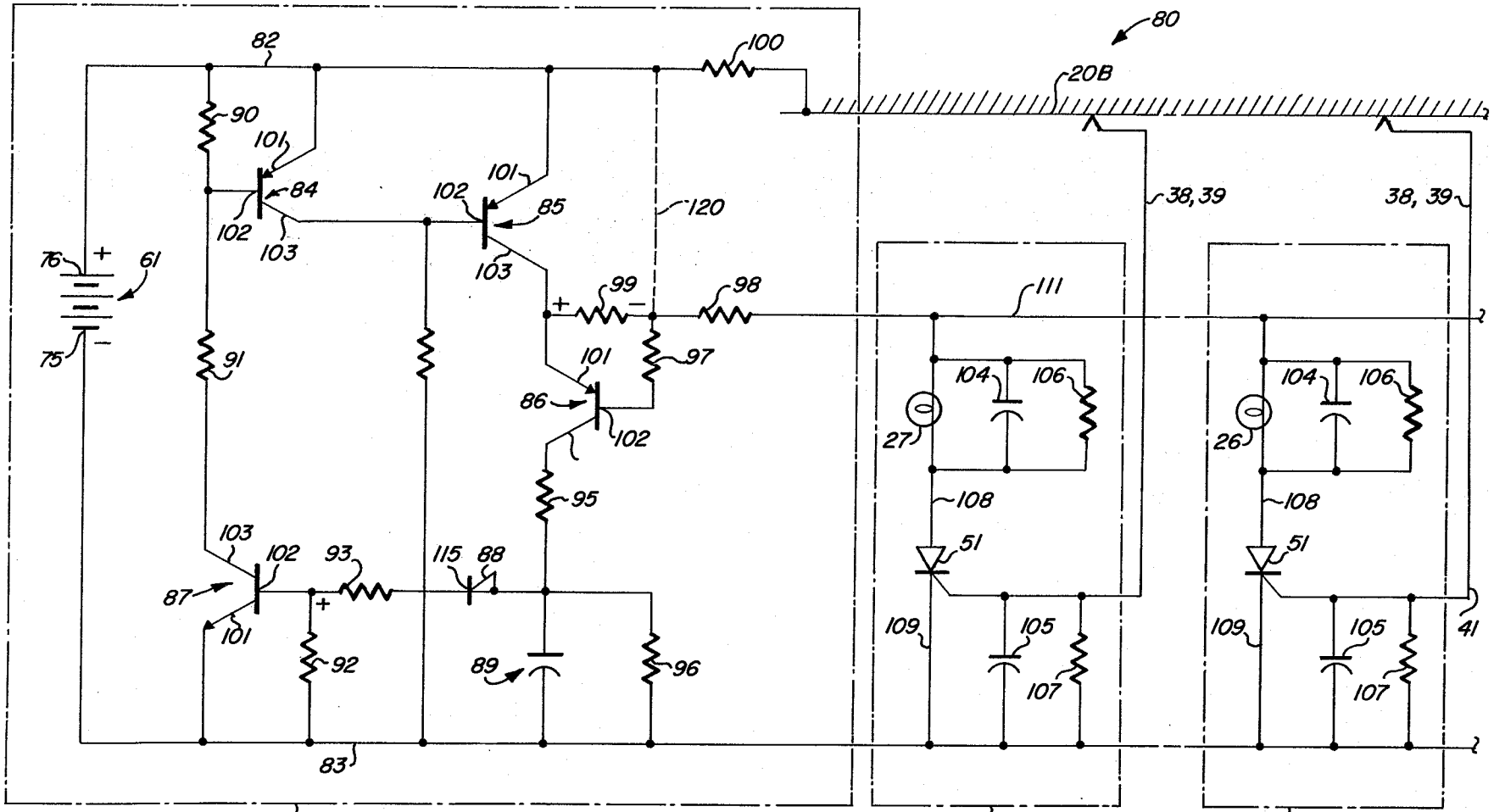
FIG. 5 is a modification of the schematic representation shown in FIG. 4 illustrating a common operating circuit for all indicating and resetting functions incorporated in the target structure.

Referring more particularly to the drawings by characters of reference, FIGS. 1, 2 and 3 illustrate the indicating target structure 10 comprising a lamp assembly 11 and a circular cluster of target sectors 12, the cluster comprising a circular center sector 13 and six identical surrounding pie-shaped sectors 14–19.

Lamp assembly 11 comprises a mounting plate 20 to which are mounted seven lamps 21–27 within seven circular holes formed in plate 20. Hole 21A is located at the center of plate 20 and the six holes 22A–27A are arranged uniformly about the circumference of a circle concentrically located with hole 21A.

Plate 20 may be laminated in two layers including an electrically insulating supporting board 20A and an electrically conducting forward surface layer 20B which is cemented to board 20A or if comprising merely a thin surface painted thereon. Lamps 21–27 may have bell-shaped reflector housings the openings of which rest against the rear surface of board 20A in suitable orientation to cause their illuminating rays to be directed forward through the seven circular holes 21A–27A.

The six target sectors 14–19 are incomplete pie sections, each having been diminished by a sector of the circular center segment 13. Center segment 13 and the six surrounding sectors 14–19 fit conformingly together substantially filling a complete circular area but with a finite and uniform spacing maintained between adjacent segments.

Each of the sectors 13–19 is molded from a tough and resilient but relatively rigid translucent plastic material. Preferably a centered circular insert 31 is provided in each sector in alignment with one of the lamps 21–27, the insert 31 being molded from a similar plastic material but having a higher degree of transparency than that of the surrounding plastic material, the insert 31 thus serving as a lens for the transmission of light from lamps 21–27.

Each of the target sectors 14–19 is secured to the forward surface of plate 20 by means of one or more flexible supports 32 and 33. Each of the supports may be formed of a resilient material such as rubber or plastic in a hollow cylindrical configuration as shown in FIG. 3 which deforms temporarily under stress. As noted from the drawing, one end of each support is secured to the rear surface of one of the target sectors 13–19 and the other end is secured to the forward surface of plate 20 by means of a screw or other suitable fastening means. Also attached to the rear surface of each target sector 13–19 are two spring contacts 38 and 39 which extend perpendicularly rearwardly from the rear surface of the target sector to a point just forward of the front surface of plate 20 where each of the contacts terminates in a right angle contact tab. Slight physical clearance is provided between contacts 38 and 39 when the segment to which they are mounted is in a rest position, but in the presence of vibratory motion of the segment relative to plate 20 as produced by the impact of a projectile, at least one momentary electrical contact is made between spring contact 38 or 39 or both and conducting surface layer 20B of plate 20. As shown in FIG. 3, the target section 13 is displaced from lamp assembly 11 for the sake of clarity; however, when assembled, assembly 11 and target section 12 are close together.

The two contacts 38 and 39 on each target sector are electrically connected together and an external electrical connection is made to each pair by one of seven electrical conductors 41. A single electrical conductor 42 makes electrical connection between conductive surface 20B of plate 20 and one end of a resistor 43. Another conductor 44 is attached to the other end of resistor 43. Two electrical conductors 45 and 46 are connected to the terminals of each of the lamps 21–27.

Associated with each target sector 13–19 is a lamp driver circuit 50 with two circuits 50 being illustrated in FIG. 4. Each circuit 50 comprises a silicon-controlled rectifier 51, transistors 52 and 53, a silicon unilateral switch 54, a capacitor 55, resistors 56–60. A battery 61, or other suitable source of power, supplies current to all of the lamp driver circuits 50 associated with sectors 56–60. In the specific example shown in FIG. 4, the lamp driver circuits 50 are each connected to a different lamp such as lamps 26 and 27 which are positioned opposite target sectors 18 and 19. Although two batteries 61 are shown in FIG. 4 for sake of illustration, only one battery is needed for all circuits 50 utilized with each circuit 50 connected across the same.

Silicon controlled rectifier 51 is a four layer semiconductor device having an anode 62, a cathode 63 and a gate 64. As in the case of a conventional diode, controlled rectifier 51 blocks current flow from cathode to anode; it also blocks current flow from anode to cathode, however, until a positive voltage pulse is applied from gate to cathode in the presence of a positive anode-to-cathode voltage, in which case it switches to a low impedance mode, readily passing current from anode to cathode. Once the controlled rectifier has been switched to the low impedance mode, it remains in this mode even after the positive gate voltage is removed. To return the device to its high impedance mode in which it blocks current from anode to cathode, it is necessary to reduce the anode to cathode current to zero by external means and to hold the current at zero for a finite period of time, typically 20–30 microseconds while the controlled rectifier recovers. The General Electric Company describes the device in detail in its several editions of its "Controlled Rectifier Manual."

Transistor 52 is an NPN semiconductor device having an emitter 65, a base 66, and a collector 67. Transistor 52 passes current from collector 67 to emitter 65 in proportion to the current supplied from base 66 to emitter 65. If the base to emitter current is substantially in excess of that required to allow the maximum current available from collector to emitter, the transistor is said to be saturated and the collector to emitter voltage drop is then typically 0.5 volts or less.

Transistor 53 is a PNP semiconductor device having an emitter 68, a base 69 and a collector 70. Except for the direction of current flow, the PNP device 53 has characteristics which are identical to those NPN devices 52. In this case, current flow is from emitter to collector and from emitter to base, and saturation is produced by providing emitter to base current in excess of that current. Numerous semiconductor texts describe the construction and characteristics of these devices, e.g. "RCA Transistor Thyristor and Diode Manual," Technical Series SC-15, Copyright 1971 by RCA Corporation.

Silicon Unilateral Switch 54 is a four-layer semiconductor device having an anode 72 and cathode 73 and a gate 74. The silicon unilateral switch is essentially a miniature controlled rectifier having an anode gate (instead of the usual cathode gate) and a built in low voltage avalanche diode between the gate and cathode. The silicon unilateral switch, or SUS, blocks current from in both directions but may be switched to a low impedance state (to pass current from anode to cathode) by applying an anode-to-cathode voltage in excess of the breakdown voltage of the internal avalanche diode. The device remains in the low impedance state until anode-to-cathode current is reduced to zero by external means. For further information on the silicon unilateral switch, see page 109 of "SCR Manual Including Triacs and Other Thyristors," Fifth Edition, Copyright, General Electric Co., 1972.

With reference again to FIG. 3, resistor 57, lamp 27 and controlled rectifier 51, anode 62 to cathode 63, are serially connected across battery 61, the negative terminal 75 of battery 61 being connected to the cathode 63 of controlled rectifier 51 and the upper end of resistor 57 being connected to the positive terminal 76 of battery 61. In the high impedance mode of controlled rectifier 51 or through serially-connected lamp 27. Resistor 56 connected from gate 64 to cathode 63 of controlled rectifier 51 bypasses leakage current flowing from anode 62 to gate 64 holding gate-to-cathode voltage at a low value, thereby preventing such leakage current from triggering the device to its low impedance state.

Transistor 53 having its emitter connected to the upper end of resistor 57 and to positive terminal 76 of battery 61, and having its base connected to the lower end of resistor 57 is serially connected with resistor 60 and capacitor 55 across battery 61, the lower end of capacitor 55 being connected to negative battery terminal 75. While controlled rectifier 51 is in its high impedance state and while there is consequently no current through or voltage drop across resistor 57, there is also consequently no current flow from emitter 68 to base 69 of transistor 53. For this reason, there is essentially no current flow from emitter 68 to collector 70 of transistor 53 or through serially-connected resistor 60 and capacitor 55.

Connected in the gate circuit of controlled rectifier 51, however, is a network which supplies a pulse of voltage and current to gate 64 under certain conditions. Conductor 41 which is shown in both FIGS. 2 and 3 to be connected to spring contacts 38 and 39 of one of the target sectors 13–19 (in this case sectors 18 and 19) and is connected to gate 64 while conductor 44 from resistor 43 is connected also to positive terminal 76 of battery 61. It is now seen that when, in response to an impact produced by a projectile striking the associated target sector 19, the resulting vibration of the target sector causes a momentary electrical contact to be made between spring contact 38 or 39 and surface layer 20B of plate 20. A pulse of current flows momentarily from positive terminal 26 of battery 61 through conductor 44, resistor 43, conductor 42, surface layer 20B, contact 38 or 39, conductor 41 and resistor 56 to negative terminal 75 of battery 61.

By virtue of the current thus caused to flow through resistor 56, a positive pulse of voltage is provided from gate 64 to cathode 63 of controlled rectifier 51 and rectifier 51 is thus triggered to its low impedance state whereupon a current is initiated which flows from positive terminal 75 of battery 61 through resistor 57, lamp 27 and controlled rectifier 51 (anode 62 to cathode 63) to negative terminal 75 of battery 61. This current flowing through lamp 27 causes it to be energized and thus to illuminate target sector 19, thereby indicating to the marksman that his projectile such as an arrow, bullet or dart has struck target sector 19. Lamps 21–27 are preferably of the flashing type similar to those used on Christmas trees wherein the internal heating of the lamp causes a bimetal switch to be opened and closed to produce the flashing operation. The flashing of the light is more readily distinguished by the marksman than is a steady light, especially if the target is located some distance away.

Once lamp 27 has been energized to indicate the particular segment which has been struck by the bullet, it is desirable that the lamp be extinguished by the resetting of the particular circuit 50 which has been triggered. This implies the restoration of controlled rectifier 51 to its high impedance state, a function which is accomplished by means of transistors 52 and 53, silicon unilateral switch 54, capacitor 55 and resistors 58, 59, and 60.

Transistor 52 is connected in parallel with controlled rectifier 51, its collector 67 connected to anode 62 of rectifier 51 and its emitter 65 connected to cathode 63 of rectifier 51. It is thus possible by virtue of the low saturation voltage of transistor 52 to divert virtually all of the current flowing from anode to cathode of rectifier 51 and to bypass it through transistor 52. Thus, if transistor 52 is held in a saturated condition for 20–30 microseconds by means of a current flowing from base 66 to emitter 65, rectifier 51 will recover to its high impedance state, and when subsequently, the base emitter current of transistor 52 is returned to zero, the current through both rectifier 51 and transistor 52 will have fallen to zero.

It was earlier shown that no current flows through transistor 53, emitter 68 to collector 70 while controlled rectifier 51 is in its "off" or high impedance state. While rectifier 51 is conducting, however, the voltage drop produced across resistor 57 produces a base-emitter current in transistor 53 causing transistor 53 to be saturated, thus causing a current to flow from positive terminal 76 of battery 61 through transistor 53, resistor 60 and capacitor 55 to negative terminal 75 of battery 61. This current flowing through capacitor 55 causes capacitor 55 to be charged to a voltage having a polarity as indicated by the + sign at the upper plate of capacitor 55. Connected serially across capacitor 55 are silicon unilateral switch 54 and resistors 59 and 58. When the voltage across capacitor 55 exceeds the turn-on voltage (typically 8 volts of silicon unilateral switch 54, switch 54 switches to its low impedance or "on" state and capacitor 55 rapidly discharges (e.g. in approximately 30 microseconds) through switch 54 and resistors 58 and 59. By virtue of the connection of the base 66 to emitter 65 terminals of transistor 52 across resistor 58, a major part of this discharge current flows from base 66 to emitter 65 causing transistor 52 to be saturated and thereby diverting current from rectifier 51 as described earlier. Once capacitor 55 has discharged to a sufficiently low value of charge, transistor 52 turns off, current through lamp 27 returns substantially to zero and causes transistor 53 also to turn off. As a consequence, the source of current to unilateral switch 54 is also cut off and switch 54 returns to its high impedance state. Circuit 50 has thus been reset as desired and the target is ready for the marksman's next shot.

The particular construction of the target 10 as described earlier, incorporating plastic target sectors 13–19 is best suited for use with rubber or plastic bullets. It is also possible, however, to utilize appropriate target materials such as very hard rubber which are suitable for use with low energy metal projectiles such as those used with air guns or low powered rifles.

It will be appreciated that various changes and modifications are possible which enhance or optimize the performance of the indicating target. It is possible, for example, to vary the member and type of elastic supporting elements 32,33 and to arrange them in a way which minimizes interference between target sectors. The shapes, number and sizes of the individual target elements may also be varied.

Fixed divider partitions may be added between target segments to prevent the bullets or projectiles from becoming lodged between sectors. A replaceable guard may also be placed around the target cluster 11 to catch and retain bullets which miss the target. A foam plastic, foam rubber or a soft compressed fiber material may be used for this purpose.

It is readily recognized that the apparatus described herein is extremely simple and inexpensive to manufacture. It has no precision parts requiring close mechanical tolerances. Target sectors 13–19 are easily molded from inexpensive materials. A minimum total number of individual parts are required.

An improved circuit 80 for the control of lamps 22–27 is shown in FIG. 5, circuit 80 offering economy over the circuit of FIG. 4 by virtue of the fact that the individual circuit sectors 50A of FIG. 5, one of which is associated with each of the individual target sectors 13–19 are much simplified with respect to the corresponding circuits 50 of FIG. 4. The simplification is made possible through the use of a common circuit sector 81 which provides the resetting function i.e. the commutation of the silicon-controlled rectifiers 51 of sectors 50A so that such commutating circuitry need not be incorporated in each of the sectors 50A.

The common circuit sector 81 of FIG. 5 is energized by connection between a positive bus 82 and a negative bus 83, positive bus 82 being connected to positive terminal 76 of battery 61, and negative bus 83 being connected to negative terminal 75 of battery 61.

Circuit sector 81 utilizes three PNP transistors 84, 85 and 86, an NPN transistor 87, a silicon unilateral switch 88, a capacitor 89, and resistors 90–100. Each of the transistors 84–87 has an emitter 101, a base 102 and a collector 103.

Each of the circuit sectors 50A utilizes a silicon-controlled rectifier 51, one of the lamps, 22–27, two capacitors, 104 and 105 and two resistors 106 and 107. The lamps 22, 23, 24, 25, 26 or 27 are connected in parallel with capacitor 104 and resistor 106, and the parallel network thus provided is serially connected with the anode-cathode terminals 108 and 109 respectively of controlled rectifier 51 between a positive bus 111 and the negative bus 83 which is common with negative bus 83 of sector 81. Capacitor 105 and resistor 107 are connected in parallel between the gate 112 and the cathode 109 of controlled rectifier 51.

Transistor 85 of sector 81 which has its emitter 101 connected to positive bus 82 is normally turned on by virtue of the connection of resistor 94 between its base 102 and negative bus 83 which permits an emitter-base current to flow from base 102 through resistor 94 to negative terminal 83. In the "on" condition, transistor 85 thus provides a low impedance connection between positive bus 82 and serially connected resistors 98 and 99 which provide a relatively low resistance path from collector 103 of transistor 85 to bus 111. In the normal or quiescent state with none of the lamps 22–27 energized, bus 111 is thus at nearly the same positive potential as bus 82 and positive terminal 76 of battery 61.

Surface layer 20B is also at the same positive potential by virtue of its connection through resistor 100 to bus 82.

As in the case of the circuit of FIG. 4, the gate 112 of controlled rectifier 51 is connected by means of a conductor 41 to contacts 38, 39 which, when activated by the impact of a bullet striking the associated target sector, make contact with surface layer 20B. During such momentary contact a gate current flows from bus 82 through resistor 100, layer 20B, contacts 38, 39, and conductor 41 to gate 112 of controlled rectifier 51, the amount of current flowing being limited by resistor 100.

Upon the delivery of gate current to gate 112, controlled rectifier 51 is switched to the "on" condition whereupon a current flows from positive bus 82 through transistor 85 (from emitter 101 to collector 103), through resistors 99 and 98 to bus 111 and thence through one of the lamps 22–27 associated with the particular activated contact 38, 39 and through the associated controlled rectifier 51 to negative bus 83. It will be recognized that in the usual case only one of the individual sectors, 50A is thus activated by the impact of a single bullet or projectile.

Returning to main sector 81 it is noted that transistor 86 has its emitter 101 connected to collector 103 of transistor 85 while serially-connected resistor 95 and capacitor 89 are connected between its own collector 103 and negative bus 83, one end of capacitor 89 being connected directly to bus 83.

As the afore mentioned current to one of the lamps 22–27 flows through resistor 99 a voltage drop is developed across resistor 99 having a polarity which is positive on the left and and negative on the right as indicated by the signs + and − shown on the drawing. Emitter 101 of transistor 86 is seen to be connected to the positive side of resistor 99 while base 102 of transistor 86 is connected through base current limiting resistor 97 to the negative side of resistor 99. An emitter-base current is thus induced in transistor 86 flowing from the positive side of resistor 99 to emitter 101, base 102 and resistor 97 to the negative side of resistor 99, the emitter-base current thereby rendering transistor 86 conductive and causing a current to flow from collector 103 of transistor 85 through transistor 86, emitter 101 to collector 103, through resistor 95 and capacitor 89 to bus 83, said current causing capacitor 89 to be charged. As capacitor 89 is thus charged, a positive voltage is developed on its upper plate 113.

Connected across capacitor 89 is a series network comprising silicon unilateral switch 88 and resistors 92 and 93, the anode 114 of silicon unilateral switch 88 being connected directly to upper plate 113 of capacitor 89, its cathode 115 connected directly to one end of resistor 93, and resistor 92 being connected between the other end of resistor 93 and the lower plate 116 of capacitor 89 which is also connected to negative bus 83.

When the charge developed across capacitor 89 reaches a voltage level sufficient to turn on unilateral switch 88 a discharge current flows from positive plate 113 through serially connected switch 88 and resistors 93 and 92 to negative plate 116. A part of this discharge current is diverted through the base-emitter junction of transistor 87 which has its base 102 connected to the upper positive end of resistor 92 and its emitter connected to the lower end of resistor 92. Transistor 87 is thereby rendered conductive and by virtue of the connection of its collector 103 to base 102 of transistor 84 through a current-limiting resistor 91, an emitter-base current is caused to flow from base 101 to emitter 102 of transistor 84 through resistor 91 and collector 103 to emitter 101 of transistor 87 to negative bus 83. Said emitter-base current renders transistor 84 highly conductive and because transistor 84 is connected directly across the emitter-base junction of transistor 85, the emitter-base current of transistor 85 is reduced essentially to zero so that transistor 85 is turned off and the supply of current to the energized lamp and associated controlled rectifier of the activated sector 50A is momentarily interrupted. During said momentary interruption the previously conducting controlled rectifier recovers to its high impedance state. When the discharge of capacitor 89 is completed base drive to transistor 87 and hence to transistor 84 reduces to zero, and transistor 85 is restored to its "on" state. The entire circuit 80 is thus restored to its quiescent condition in readiness for the subsequent operation.

As transistor 85 is restored to its "on" state, the abrupt rise of voltage on bus 111 has a tendancy to cause controlled rectifiers 51 to be turned on. Such erratic turn-on is prevented by the connection of capacitor 105 and resistor 107 between gate 112 and cathode 109.

In some cases it is desired to employ a type of lamp 22–27 which flashes by means of an internal switch which interrupts continuity through the lamp by thermal action. Such interruption would cause the commutation of controlled rectifier 51 were it not for resistor 106 connected in parallel with the lamp, the resistor providing continuity of current to the controlled rectifier during the open condition of the internal lamp switch. Capacitor 104 suppresses electrical noise across the lamp during flashing which otherwise also produces erratic operation of controlled rectifier 51.

Further simplification of the circuit 80 is possible through the use of such a lamp with an internal or external thermally operated switch to interrupt lamp current and through the utilization of such current interruption as the means for commutating the controlled rectifier.

If such a means is employed it is possible to omit all curcuit elements within sector 81 with the exception of battery 61 and resistors 98 and 100 together with the elimination of resistors 106 across capacitors 104 of the sectors 50A. The left-hand end of resistor 98 would then connect directly to bus 82 as indicated by broken line 120. Operation then occurs as follows: Controlled-rectifier 51 is turned on as before by gate current flowing in response to the activation of contacts 38, 39. Lamp current flows through controlled rectifier 51 until interrupted by the thermal switch, said interruption commutating the controlled rectifier and resetting the circuit for the next operation.

If desired, a large target of the type disclosed may be used for golf with the golfer, off at a distance, driving the ball into the target thereby indicating the accuracy of his drive.

Although but one embodiment of the present invention has been illustrated and described, it will be apparent to those skilled in the art that various changes and modifications beyond those already suggested may be made therein without departing from the spirit of the invention or from the scope of the appended claims.

What is claimed is:

1. A target impenetratable to the projectiles used for automatically registering the position of the projectile impact comprising in combination:

a sectionalized impact plate consisting of a plurality of interfitting flush translucent segments which are separated from each other and movable independently of each other, a back plate arranged substantially coextensive with the sectionalized impact plate, said back plate having a plurality of perforations one aligned with each of said segments, a plurality of electric lamp means mounted on the side of said back plate opposite to said impact plate with lamp means mounted to direct its rays of light through a different one of said perforations against its associated segment, a conductive surface mounted on said back plate juxtapositioned to said impact plate, at least one elastically deformable post interconnecting said back plate and each segment of said impact plate for suspending said segment from said back plate a predetermined distance therefrom, at least one conductive member mounted on each of said segments and extending laterally thereof toward said back plate, a conductive member of each segment and said conductive surface being electrically connected in series to form a plurality of parallelly arranged circuits, each circuit energizing a different one of said lamp means across a source of electric power, said segments of said impact plate being spaced from said back plate a distance such that upon impact of a projectile against one of said segments of said impact plate the conductive member associated with said one of said segments engages said back plate to complete an electric circuit through its associated lamp means thereby illuminating this segment;

each of said perforations being aligned with approximately the center of its associated segment, each of said lamp means comprising a first circuit means including an incandescent lamp connected in parallel with a different one of said circuits and energized by the flow of current through the associated conductive member, and a second circuit means connected in parallel with each of said first circuit means for interrupting the current flow through its associated first circuit means after a predetermined energization of the associated lamp, thereby placing the target back in its initial condition, said second circuit means comprising a bimetallic element in series with said source of electric power to sequentially open and close the circuit to an incandescent lamp to cause it to blink.

2. The target set forth in claim 1 wherein:

said elastically deformable posts comprise a hollow cylindrical member.

3. The target set forth in claim 1 wherein:

each of said first circuit means further comprises a silicon controlled rectifier rendered conductive by flow of current through said conductive member of each segment.

4. The target set forth in claim 1 wherein:

said second circuit means comprises a capacitor the charging time of which controls the time of energization of the associated lamp.

* * * * *